US005863453A

United States Patent [19]

Hardin

[11] Patent Number: 5,863,453

[45] Date of Patent: Jan. 26, 1999

[54] FORM CONNECTOR

[76] Inventor: James W. Hardin, 3561 Cahaba Beach Rd., Birmingham, Ala. 35242

[21] Appl. No.: 366,451

[22] Filed: Dec. 30, 1994

[51] Int. Cl.[6] ..... E04G 9/00; E04G 11/06; E04G 17/06

[52] U.S. Cl. ..... 249/196; 249/6; 249/45; 249/47; 249/219.1

[58] Field of Search ..... 249/1, 6, 45, 47, 249/192, 196, 219.1

[56] References Cited

U.S. PATENT DOCUMENTS

| | | | |
|---|---|---|---|
| 1,523,961 | 1/1925 | Heltzel . | |
| 1,700,798 | 2/1929 | Heltzel | 249/6 |
| 1,963,984 | 6/1934 | Garrett | 249/192 |
| 2,793,416 | 5/1957 | Yearling | 25/118 |
| 2,875,500 | 3/1959 | Stough | 249/6 |
| 3,136,023 | 6/1964 | Von Drasek | 249/192 |
| 3,436,053 | 4/1969 | Person et al. | 249/45 |
| 3,689,024 | 9/1972 | Notzel | 249/186 |
| 3,753,545 | 8/1973 | Stegmeier | 249/219 |
| 3,778,019 | 12/1973 | Stegmeier | 249/189 |
| 4,194,717 | 3/1980 | Easton et al. | 249/196 |
| 5,154,837 | 10/1992 | Jones | 249/2 |

*Primary Examiner*—Karen Aftergut
*Attorney, Agent, or Firm*—Wm. Randall May

[57] ABSTRACT

An apparatus for interconnecting form structures, such as formboards and the like, is disclosed which allows for the permanent or removable attachment of a connecting device to the ends of adjacent form structures and which provides for the quick and easy assembly and disassembly of the forms. The connecting device employs opposing connector plates which can be permanently or removably mounted to abutting ends of successive form structures and has a latching device which allows the connector plates to be quickly and easily latched and unlatched for efficient assembly and disassembly of the forming structures.

2 Claims, 2 Drawing Sheets

FORM CONNECTOR

BACKGROUND OF THE INVENTION

I. Field of the Invention

This invention relates very generally to splicing methods and devices and, more specifically, to a new and improved method and apparatus for interconnecting form structures used in forming and/or aligning moldable or stackable building materials such as concrete and masonry.

II. Prior Art and other Considerations

Form structures, such as wooden formboards or metallic forms, are used almost universally as framing barriers for moldable or stackable building materials such as poured and block concrete and other masonry materials. Use of such forming structures is apparent in the construction and formation of various works such as driveways, sidewalks, curbing, retaining walls and foundations. Interconnection of formboards is required for framing jobs which have extended lengths. Typically, the interconnection of successive formboards for such jobs has been accomplished by what is commonly known as "cleating", wherein a "cleat", consisting of a small piece of board or metal, is used to connect or splice the ends of the formboards together in order to construct the particular framing barriers required for each job. Where wooden formboards are used, the connecting cleats are usually nailed in place and must be physically removed from the formboards after each use in order for the boards to be transported and stored for future use. Upon completion of a job, the formboard cleats are generally removed by the fastest method available which usually means severing the cleats from the end of each formboard. The obvious disadvantage of this method is the shortening of, and/or damage to, the formboards each time they are used. The cost of materials and the time and labor necessary to construct and remove these forms are critical to the economic success of each project.

Various devices, such as those disclosed in U.S. Pat. No. 5,154,837 (Jones) and 3,753,545 (Stegmeier) have been proposed for use in connecting successive formboards. These devices, however, generally have not been commercially accepted and typically employ a type of sleeving device which must be inserted onto the ends of adjacent formboards each time the boards are to be used. The use of a sleeve connector limits the size of board which may be used with the device and also creates unwanted edges or creases in the concrete or other moldable material poured adjacent to said sleeve. These sleeving devices also require the use of flexing slots, stops, "stake pockets" or additional boards for proper operation and use and must be removed from the form structures and reinstalled for each job.

A continuing need exists, therefore, for the provision of method and apparatus for interconnecting framing barriers, such as formboards and the like, which can be permanently installed onto the ends of formboards and which is not restricted by the size of form structures and which is easily adaptable to virtually any type of connecting form. Applicant's method and device addresses these needs and effectively overcomes the cited and other unwanted characteristics associated with the prior art.

SUMMARY OF THE INVENTION

In view of the foregoing, it is a primary object of this invention to provide method and apparatus for an improved form connector for use in the construction of framing barriers for moldable or stackable building materials.

An advantage of the present invention is the provision of a form connector which can be used and reused without damaging form structures.

An advantage of the present invention is the provision of method and apparatus for interconnecting form structures which can be used with virtually any size or type of form structure, including metal forms.

Another advantage of the present invention is the provision of method and apparatus for interconnecting formboards which allows for the permanent attachment of a connecting device to the ends of adjacent formboards and which provides for the quick and easy assembly and disassembly of the forms.

Another advantage of the present invention is the provision of method and apparatus for the interconnection and disassembly of form structures which saves a tremendous amount of time and labor over existing methods and devices.

A further advantage of the present invention is the provision of a form connector apparatus which is very simple to make and use and which can be used to interconnect long lengths of barrier material over uneven terrain and will effectively accommodate flexing and bending of said material.

A further advantage of the present invention is the provision of a form connector apparatus which can be used to interconnect forming structures without creating unwanted seams, edges or creases in the concrete or other moldable material adjacent to said form connector apparatus.

According to an embodiment of the invention, a form connector apparatus comprises a pair of opposing connector plates, a pair of latch sleeves rigidly attached to said opposing plates in a manner which allows said sleeves to align laterally to form a common channel, a connector latch designed to be slidably received within the common channel created by said latch sleeves, means to releaseably secure said connector latch within said latch sleeves, and means to secure said plates to forming structures such as formboards. In use, said plates are first secured to the abutting ends of adjacent forming structures to be coupled. The connector latch may then be slidably positioned within the channel formed by the opposing latch sleeves of said plates and secured in place. The formboards may then be properly positioned to create the appropriate framing barrier as required by a particular job. Once the forming job is completed, the forming structure can then be quickly and easily disassembled and stored for future jobs by simply removing the connector latch from between each set of opposing connector plates.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
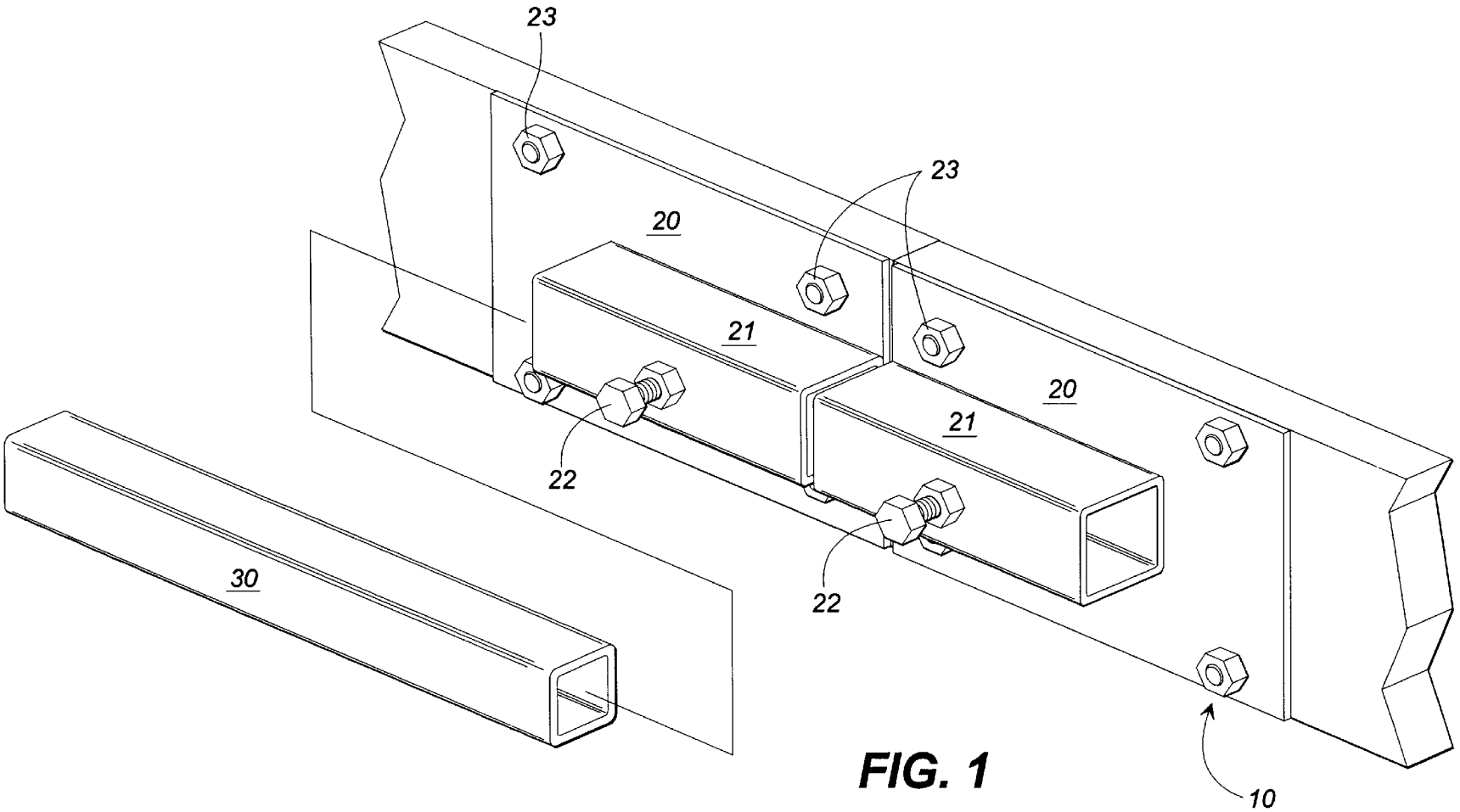
FIG. 1 is a perspective view of an embodiment of the invention shown attached to abutting ends of opposing and adjacent formboards.

FIG. 1 shows a form connector apparatus 10 according to an embodiment of the invention. The form connector 10 comprises a pair of flat, laterally opposing, connector plates 20 with each plate 20 having a latch sleeve 21 rigidly attached thereto for slidably receiving a portion of a latch means 30, means 22 to releaseably secure said latch means 30 within said latch sleeves 22, and means 23 to secure said opposing plates 20 to adjacent ends of forming structures such as wooden formboards and the like.

Figure 2:
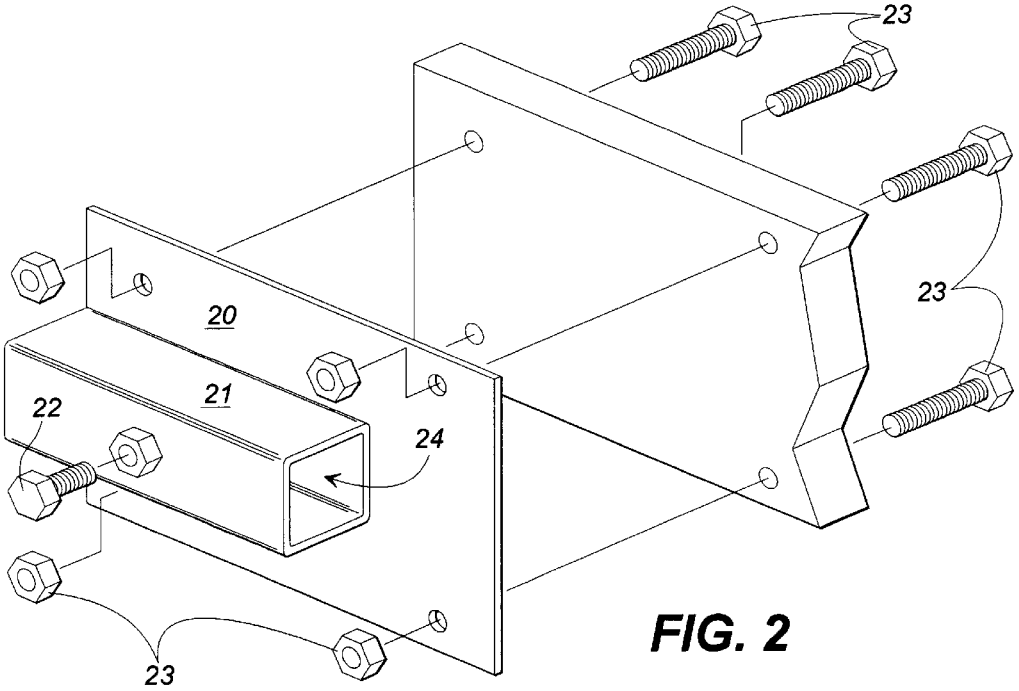
FIG. 2 is an exloded perspective view of the embodiment of FIG. 1 showing an opposing connector plate as it would be attached to a typical form structure.
Figure 3:
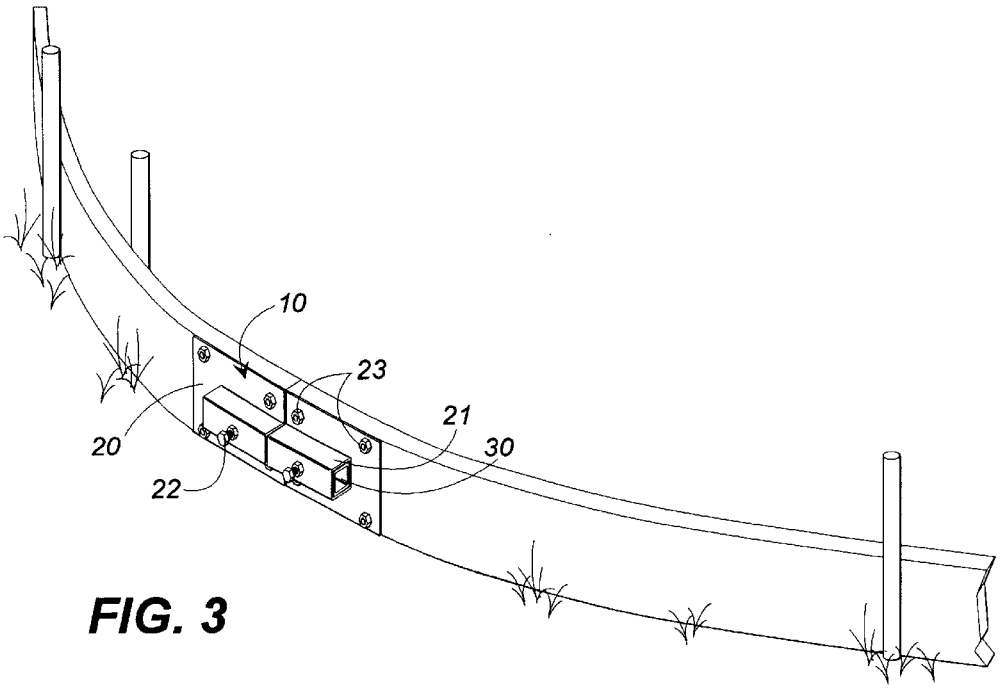
FIG. 3 is a perspective view of the embodiment of FIG. 1 shown attached and latched to opposing and adjacent formboards along an arcuate section of the form structure.

The opposing connector plates 20 are formed of rigid material such as small-gauge plate steel and are generally rectangular in shape, however, the shape of the plates 20 is not determinative of the usefulness of the invention and can be varied without affecting the function and effectiveness of the device. The latch sleeves 21 of the present embodiment are comprised of rigid tubular material, such as tubular steel, and are generally square or rectangular in shape. The latch sleeves 21 are each rigidly attached, as by welding, to one of the opposing connector plates 20 in a manner which causes said sleeves 21 to align laterally to form a common channel 24 when the opposing plates 20 are placed end to end. The latch sleeves 21 are sized to slidably receive the latch means 30 within the common channel 24 created by said sleeves 21. The latch means 30 comprises a length of tubular material, such as tubular steel, having cross-sectional dimensions which slidably match the dimensions of the latch sleeves 21 so that said latch means 30 may be easily inserted into the channel 24 created by said sleeves 21 when said opposing plates 20 are placed end to end. As can be better seen in FIG. 2, the latch securing means 22, in the present embodiment, comprises a common bolt which is threadably received through a wall of each latch sleeve 21 so that the tightening of said securing means 22 causes said securing means 22 to contact a portion of the latch means 30 located within each sleeve 21 thereby securing said latch 30 to said sleeve 21. The plate securing means 23 in the present embodiment comprise a plurality of common nuts and bolts of sufficient number, length and size to effectively secure the opposing plates 20 of the invention 10 to adjacent ends or sides of the particular form structures being coupled.

In use, the opposing plates 20 are first secured to abutting ends of adjacent form structures, such as wooden formboards, using the plate securing means 23. The latch means 30 is then slidably positioned within the channel 24 created by the aligned latch sleeves 21 and is secured thereto by tightening the latch securing means 22 at each latch sleeve 21. This procedure is repeated for as many successive formboards as may be required by the particular job. The connected formboards may then be properly positioned to create the desired framing barrier as required by the job. Once the forming job is completed, the form structure can then be quickly and efficiently disassembled and stored for future use by simply loosening one or both of the latch securing means 22 and by slidably removing the latch means 30 from the channel 24 of one or both of said latch sleeves 21.

While the invention has been particularly shown and described with reference to the preferred embodiment(s) thereof, it will be understood by those skilled in the art that various alterations in form, detail and construction may be made therein without departing from the spirit and scope of the invention.

The embodiments of the invention in which an exclusive property right or privilege is claimed are defined as follows:

1. A reusable form connector for interconnecting adjacent framing structures consisting essentially of:

a pair of plate members for attachment to abutting ends of adjacent framing structures with each plate member having a tubular sleeve member rigidly attached thereto on one side in a manner which causes said tubular sleeve member of a first plate member to align laterally with said tubular sleeve member of a second plate member to form a continuous common channel for slidably and releaseably receiving a latch means when said plate members are positioned end to end;

said latch means comprising a tubular latch member having an elongated section of rigid tubular material with external cross-sectional dimensions slidably compatible with internal cross-sectional dimensions of said laterally aligned tubular sleeve members to provide sufficient tolerance to allow said form connector to accommodate elevational changes in terrain and to allow said form connector to be used effectively with curved or arcuate framing structures and wherein said latch member is slidably and releaseably received by said continuous common channel formed by said laterally aligned tubular sleeve members when said plate members are positioned end to end;

means associated with said tubular sleeve members to adjust and releaseably secure said latch means within said laterally aligned tubular sleeve members; and, means to secure said plate members to said abutting ends of said adjacent framing structures such that said reusable form connector accommodates flexing and bonding of said adjacent framing structures.

2. A reusable form connector for interconnecting successive framing structures consisting essentially of a pair of flat, laterally opposing, plate members with each plate member having a tubular sleeve member rigidly attached on one side thereof for slidably and releaseably receiving a portion of a tubular latch member, said tubular sleeve members being rigidly attached to said plate members in a manner whereby said tubular sleeve members are caused to be in lateral alignment with each other thereby forming a continuous, common channel for slidably and releaseably receiving said tubular latch member when said plate members are positioned end to end, a means associated with said tubular sleeve members to adjust and releaseably secure said tubular latch member within said laterally aligned tubular sleeve members when said laterally opposing plate members are positioned end to end, said tubular latch member comprising an elongated section of rigid tubular material having external cross-sectional dimensions slidably compatible with internal cross-sectional dimensions of said laterally aligned tubular sleeve members to provide sufficient tolerance to allow said form connector to accommodate elevational changes in terrain and to allow said form connector to be used effectively with curved or arcuate framing structures, and a means to secure said laterally opposing plate members to adjacent, abutting ends of said successive framing structures such that said reusable form connector accommodates flexing and bending of said successive framing structures.

* * * * *